United States Patent [19]

Kichise

[11] Patent Number: 4,472,954

[45] Date of Patent: Sep. 25, 1984

[54] KEY

[76] Inventor: Hirakazu Kichise, 1-24 4-chome, Watanabedori, Chuo-ku, Fukuoka, Japan

[21] Appl. No.: 402,237

[22] Filed: Jul. 27, 1982

[51] Int. Cl.[3] ..... E05B 19/04

[52] U.S. Cl. ..... 70/408

[58] Field of Search ..... 70/408, 393, 402; 40/2 A, 330

[56] References Cited

U.S. PATENT DOCUMENTS 2,672,747 3/1954 Craig ..... 70/408
3,541,818 11/1970 Dana ..... 70/408
4,188,741 2/1980 Levy ..... 40/2 A

FOREIGN PATENT DOCUMENTS 1151449 7/1963 Fed. Rep. of Germany ..... 70/408
2149008 3/1973 France ..... 70/408

*Primary Examiner*—Robert L. Wolfe
*Attorney, Agent, or Firm*—Brisebois & Kruger

[57] ABSTRACT

This invention relates to a key capable of being distinguished easily from any one of a plurality of keys for different uses carried therewith; held between the fingers conveniently during locking and unlocking operations; and determined easily in advance as to the direction, in which the key is to be inserted into a key hole.

2 Claims, 8 Drawing Figures

KEY

BACKGROUND OF THE INVENTION

1. Field of the Invention

This invention relates to a key capable of being distinguished easily from any one of a plurality of keys for different uses carried therewith; held between the fingers conveniently during locking and unlocking operations; and determined easily in advance as to the direction, in which the key is to be inserted into a key hole.

2. Description of the Prior Art

A holding portion of a conventional key is formed usually flatly to a small thickness. Such a holding portion is difficult to be kept between the fingers during locking and unlocking operations. Such a key cannot be distinguished easily from any one of a plurality of keys for different uses carried therewith, so that it takes time to find out a desired key among these keys. In case of a key, of which the right and left sides or front and rear sides of an inserting portion are notched or recessed asymmetrically, it is necessary that the direction, in which the key is to be inserted into a key hole therefor, be determined in advance. Thus, a conventional key is troublesome and inconvenient in various respects.

SUMMARY OF THE INVENTION

An object of the present invention is to provide a key, which is provided with an arbitrarily-shaped, colored overlay of a synthetic resin on a holding portion thereof to allow the key to be held conveniently during locking and unlocking operations, and distinguished from any one of a plurality of types of keys for different uses carried therewith and have overlays of different colors on the respective holding portions, and further allow the key to be found out easily among these keys, whereby the direction, in which the key is to be inserted into a key hole therefor, can be determined easily in advance owing to the overlays of different shapes consisting of a synthetic resin and formed on the front and rear sides of the holding portion even if the inserting portion of the key is notched or recessed asymmetrically.

DESCRIPTION OF THE PREFERRED EMBODIMENTS

Figure 1:
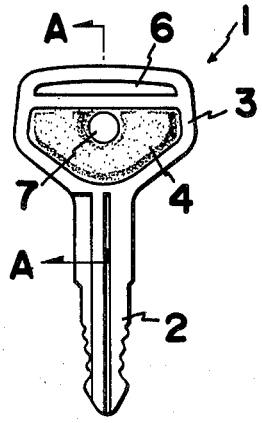
FIG. 1 is a front elevational view of a first embodiment of the present invention.
Figure 2:
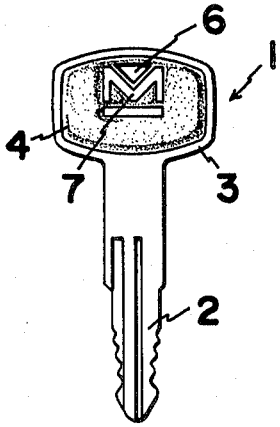
FIG. 2 is a front elevational view of a second embodiment of the present invention.
Figure 3:
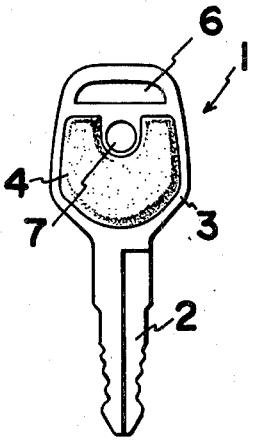
FIG. 3 is a front elevational view of a third embodiment of the present invention.
Figure 6:
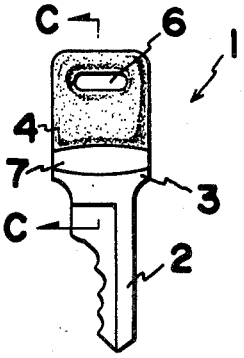
FIG. 6 is a front elevational view of a fifth embodiment of the present invention.
Figure 5:
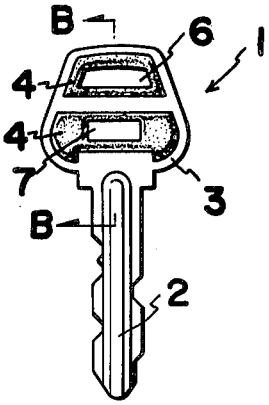
FIG. 5 is a front elevational view of a fourth embodiment of the present invention.
Figure 4:
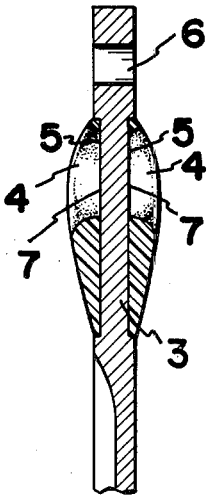
FIG. 4 is an enlarged sectional view taken along the line A—A in FIG. 1.
Figure 8:
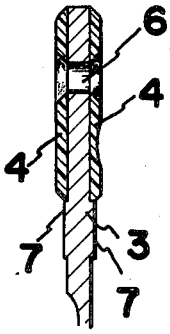
FIG. 8 is an enlarged sectional view taken along the line C—C in FIG. 6.
Figure 7:
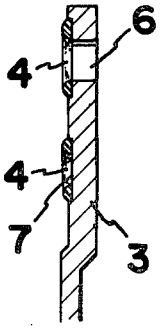
FIG. 7 is an enlarged sectional view taken along the line B—B in FIG. 5.

The embodiments of the present invention will be described in detail with reference to the accompanying drawings. FIGS. 1-3 are front elevational views of first, second and third embodiments, respectively, of the present invention, FIG. 4 an enlarged sectional view taken along the line A—A in FIG. 1, FIGS. 5 and 6 front elevational views of fourth and fifth embodiments respectively, FIG. 7 an enlarged sectional view taken along the line B—B in FIG. 5, and FIG. 8 an enlarged sectional view taken along the line C—C in FIG. 6.

The keys 1 of the first to third embodiments are formed so as to have symmetric outer shapes of right and left and front and rear sides of inserting portions 2 thereof, and do not require to be determined in advance with respect to the direction, in which the keys are to be inserted into key holes therefor. Therefore, the holding portions 3 of these keys 1 has overlays 4 of the same shape consisting of a colored synthetic resin and formed on the front and rear sides thereof.

The keys 1 of the fourth and fifth embodiments are formed so as to have symmetric outer shapes of right and left and front and rear sides of inserting portions 2 thereof, and require to be determined in advance with respect to the direction, in which the keys are to be inserted into key holes therefor.

These keys are provided with their respective overlays 4 of a transparent or opaque, hard synthetic resin having arbitrarily selected color.

Each of the holding portions 3 of these keys is provided in arbitrary sections thereof with a bore 6 of an arbitrary shape, and a marking region 7 for use in putting a trademark or a name thereon.

The first embodiment (refer to FIGS. 1 and 4) is provided in lower half sections of front and rear sides of the holding portion 3 thereof with flat recesses 5, 5, on the surfaces of which overlays 4, 4 of a colored synthetic resin are formed in such a manner that the overlays 4, 4 on the front and rear sides of the key are symmetric with each other.

In this embodiment, a horizontally elongated bore 6 extends in an upper section of the holding portion 3 so as not to cross the overlays 4, 4 of a colored synthetic resin, and a round marking regions 7 are formed by partially cutting the overlays 4, 4.

The second embodiment (refer to FIG. 2) is provided with overlays 4 of a colored synthetic resin in such a manner that the overlays 4 extend on substantially the whole of the front and rear sides of the holding portion 3 thereof and symmetrically with each other.

A triangular bore 6 in this embodiment is made so as to extend through the overlays 4 of a colored synthetic resin. Also, a marking region 7 in the shape of the letter, "M" is provided in that section of the overlay 4 of a colored synthetic resin which is under the bore 6.

The third embodiment (refer to FIG. 3) is provided in lower half sections of front and rear sides of the holding portion 3 thereof with overlays 4 of a synthetic resin 4 in such a manner that the overlays 4 are symmetrical with each other.

In this embodiment, a horizontally elongated bore 6 extends in an upper section of the holding portion 3 so as not to cross the overlays 4, 4 of a colored synthetic resin, and a round marking region 7 is formed in that section of the holding portion 3 which corresponds to an upper recess 8 in the overlay 4 of a colored synthetic resin in such a manner that the circumferential part of the marking region 7 does not contact that of the overlay 4.

The fourth embodiment (refer to FIGS. 5 and 7) is provided on the front side only of a holding portion 3 thereof with overlays 4 of a synthetic resin, which are spaced from each other vertically on the same side of the holding portion 3.

In this embodiment, a horizontally elongated bore 6 is made in the upper colored overlay 4, and a rectangular marking region 7 is formed in the lower colored overlay 4 by partially cutting the same.

The fifth embodiment (refer to FIGS. 6 and 8) is provided on the whole of the upper half sections of the front and rear sides of the holding portion 3 thereof with overlays 4, 4 of a colored synthetic resin having different longitudinal sectional shapes.

In this embodiment, the horizontally elongated bore 6 is provided in the overlays 4 of a colored synthetic resin, and marking regions 7, 7 are formed in those sections of the holding portion 3 which are below the overlays 4, 4 of a colored synthetic resin.

The embodiments of the present invention are constructed as described above. All of the keys of the first to fifth embodiments are used as the holding portions 3 thereof are kept between the fingers at the overlays 4 of a colored synthetic resin. These keys 1 can be conveniently held between the fingers since the holding portions 3 thereof are formed to a large thickness. The overlays 4 of a synthetic resin of these keys may have arbitrary colors. If each of a plurality of types of keys is provided with overlays 4 of a synthetic resin having a specific color, these keys can be distinguished easily from one another owing to the colors of the overlays thereof even when all of the keys are carried together.

In the fourth and fifth embodiments in particular, the outer shapes of the inserting portions 2 thereof are asymmetric at the right and left sides thereof and front and rear sides thereof. Accordingly, it is necessary that the direction, in which the inserting portions 2 of these keys are to be put into key holes therefor, be determined in advance. In the holding portion 3 of the fourth embodiment, an overlay 4 of a synthetic resin is provided on the front side only thereof. Therefore, the moment the user pick up the key to touch the holding portion 3 thereof, he can determine the direction, in which the inserting portion 2 of the key is to be put into the key hole therefor. Thus, the key is not erroneously inserted into the key hole therefor.

In the fifth embodiment, the overlays 4,4 of a colored synthetic resin are formed asymmetrically on the front and rear sides of the holding portion 3 thereof. Accordingly, the moment the user touches the holding portion of the key, he can determine the direction, in which the key is to be inserted into the key hole therefor, just as in the case of the key of the fourth embodiment.

In order to fasten the key 1 to a key holder, a hook of the latter may be inserted into the bore 6 in the former. If a trademark or a full name of a person is put on the marking region 7 of the key 1, the possessor thereof can be identified when the key 1 is lost.

What is claimed is:

1. A key comprising a holding portion having opposed faces and an insertion portion extending therefrom for insertion in a keyhole of a lock, an elongated slot in an upper section of said holding portion and remote from said insertion portion, said slot extending through the holding portion from one face to the other and defining an opening for mounting the key on a key holder, overlays of colored synthetic resin formed symmetrically on said opposed faces of the holding portion, each overlay having a recess defining a round marking region between said slot and the insertion portion of the key, said recess providing a finger grip to assist gripping the key by the user.

2. A key according to claim 1 wherein said round marking regions are a surface of a body portion of the key, and surfaces of said overlays curve inward toward said marking regions.

* * * * *